US006829866B2

(12) United States Patent
Mattle

(10) Patent No.: US 6,829,866 B2
(45) Date of Patent: Dec. 14, 2004

(54) WOODEN BEAMS WITH SECTIONS THAT ARE SUBJECTED TO TRANSVERSAL TENSION

(75) Inventor: Paul Mattle, Widnau (CH)

(73) Assignee: SFS intec Holding AG, Heerbrugg (CH)

( * ) Notice: Subject to any disclaimer, the term of this patent is extended or adjusted under 35 U.S.C. 154(b) by 0 days.

(21) Appl. No.: 10/239,265

(22) PCT Filed: Mar. 19, 2001

(86) PCT No.: PCT/EP01/03122

§ 371 (c)(1),
(2), (4) Date: Sep. 20, 2002

(87) PCT Pub. No.: WO01/71120

PCT Pub. Date: Sep. 27, 2001

(65) Prior Publication Data

US 2003/0029128 A1 Feb. 13, 2003

(30) Foreign Application Priority Data

Mar. 21, 2000 (DE) ..... 100 13 810

(51) Int. Cl.[7] ..... E04C 3/00; E04C 3/30

(52) U.S. Cl. ..... 52/223.4; 52/223.8; 52/223.14; 52/730.7; 52/737.3

(58) Field of Search ..... 52/730.7, 223.8, 52/233, 300, 286, 92.1, 92.2, 92.3, 93.1, 794.1, 309.9, 309.14, 737.3, 731.2, 745.06, 745.07, 747.1, 223.7, 821, 690, 227, 720, 736, 730, 741.1, 731.3, 731.4, 732.3, 223.4, 223.5, 223.6, 223.13, 223.14, 698, 699, 701, 703, 712, 715; 411/413, 399, 387.6, 412, 387.1, 387.2, 387.3, 387.4, 387.5, 387.7, 387.8

(56) References Cited

U.S. PATENT DOCUMENTS 2,342,916 A * 2/1944 Blaski ..... 52/86
3,605,360 A * 9/1971 Lindal ..... 52/223.8
4,501,102 A * 2/1985 Knowles ..... 52/690
4,648,225 A * 3/1987 Waddell ..... 52/288.1
4,741,144 A * 5/1988 Graffin ..... 52/724.5
5,048,256 A * 9/1991 Thorsnes ..... 52/730.7
5,050,366 A * 9/1991 Gardner et al. ..... 52/730.7
RE35,327 E * 9/1996 Sing ..... 52/309.9
5,565,057 A * 10/1996 Owens ..... 156/304.1
5,806,266 A * 9/1998 Jennings et al. ..... 52/644
5,832,681 A * 11/1998 Johnson ..... 52/210
5,852,909 A 12/1998 Soltis et al.
6,325,583 B1 * 12/2001 Mattle et al. ..... 411/413
6,588,161 B2 * 7/2003 Smith ..... 52/233

FOREIGN PATENT DOCUMENTS

| | | |
|---|---|---|
| DE | 236563 | 6/1986 |
| DE | 19741735 | 4/1999 |
| GB | 2150969 | 7/1985 |
| WO | 9857005 | 12/1998 |

OTHER PUBLICATIONS

Blass & Steck, Querzugverstärkungen . . . (English: Transverse Reinforcement . . . ) Apr. 1999, pp. 44–49.

Möhler & Siebert, Untersuchungen . . . (English: Investigations . . . ) Jun. 1984, pp. 388–393.

* cited by examiner

*Primary Examiner*—Jeanette Chapman
(74) *Attorney, Agent, or Firm*—Volpe and Koenig, P.C.

(57) ABSTRACT

A wooden beam (1) has several sections which are subjected to a transversal tension and which affect in particular the areas in which there are recesses or openings (3). Rod-shaped elements are provided in the form of screws (4) which are introduced in such a way that they extend crosswise to the longitudinal direction of the beam (1) in order to absorb this transversal tension. These screws are screwed in from the top side (5) or the underside (6) of the beam (1) and each extend over part of the height (H) of the beam (1) only and are therefore directly associated with the area (2) that is subjected to transversal tension.

8 Claims, 2 Drawing Sheets

WOODEN BEAMS WITH SECTIONS THAT ARE SUBJECTED TO TRANSVERSAL TENSION

Figure 1:
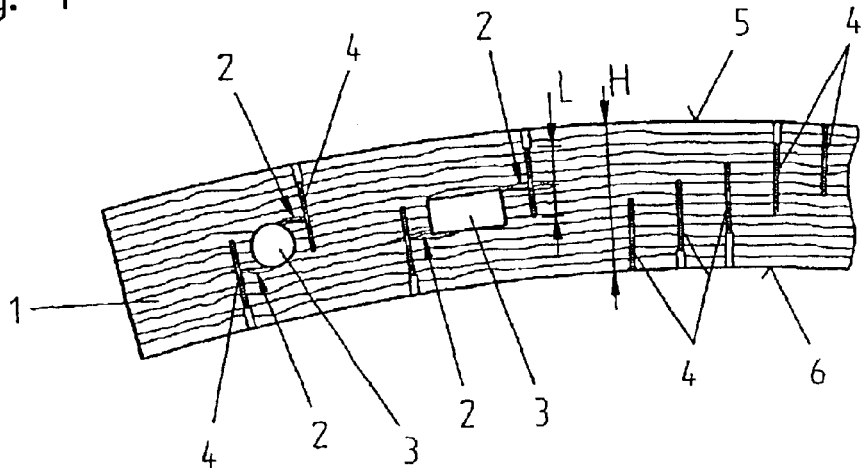

The invention relates to a wooden beam having sections which are subjected to transverse tension, which are reinforced by rod-shaped elements which are positioned to extend essentially transversely to its longitudinal direction.

Especially at through-holes in the span of such wooden beams, or else in the vicinity of their ends, if cut-outs are provided in the vicinity of the superposition region, there arise exceptional stresses due to forces which act transversely to the grain orientation, so that in those areas tears and cracks can form in the wooden beam parallel to the grain orientation.

It has already been proposed to insert, precisely in those sections of wooden beams subjected to transverse tension, rod-shaped elements for special reinforcement. In general, these rod-shaped elements were glued into pre-drilled holes. This yielded a certain amount of beam strengthening transversely to its longitudinal direction, i.e. transversely to the grain orientation.

In this regard, the premise is that the drill holes provided for the insertion of the rod-shaped elements heretofore normally extended over the entire height of a beam, or were provided at least starting at the top or at the bottom of the beam until well beyond the section that was actually subjected to transverse tension. On the one hand, this causes a corresponding consumption of time for creating the drill hole, for inserting the rod-shaped element and for gluing it in, and on the other hand, there results an exceptional consumption of materials through correspondingly long rod-shaped elements and a correspondingly large required quantity of adhesive.

The present invention has as its objective to substantially improve the reinforcement possibilities for a beam of the initially described variety in the region of sections subjected to transverse tension.

This is accomplished in accordance with the invention by forming the rod-shaped elements of screws which are provided with threaded segments at both of their end regions, which extend over a zone subjected to transverse tension, which are screwed in from the top or the bottom of the beam, which extend only over a portion of the height of the beam and which are therefore associated directly with the zone that is subjected to transverse tension.

Through these inventive measures, it has become possible to utilize relatively short screws instead of the prior, very long rod-shaped elements. Absorption of the tension forces is carried out solely by the threaded portions, which are engaged in the wood of the beam.

By means of the invention, there has been created the possibility, in practice, to utilize a screw for the present purpose, which is inserted appropriately deeply and is therefore located where corresponding transverse tension forces occur. This is advantageous especially for exceptionally tall wood beams. Such beams can have a height of one meter or more, but reinforcement due to the prevailing transverse tension is needed only over a predetermined segment of the beam height.

A preferred embodiment is one in which the screws extend approximately equally far above and below a zone of increased transverse tension. This ensures that the thread portions which are present at both ends of the screw provide adequate anchoring to essentially equal degrees, so that the transverse tension forces can be absorbed without any problems. However, such an arrangement becomes possible only if the screws can be screwed into the wooden beam less deeply or even more deeply, as appropriate.

In this connection, it is preferred that the length of the screws be chosen shorter than one half the height of the beam. Especially for beams of exceptional height this yields a very substantial saving of material and furthermore, especially when using screws with threaded sections, there occurs the lowest possible insertion turning moment. Such screws can be screwed into the wood beam without predrilling a hole, which also makes possible an appropriately deep insertion.

Especially in a wood beam of relatively great height, there occur in certain regions—for example in the middle region of a curved beam—several sections subjected to transverse tension, and this can affect layers in all regions relative to the height of the beam. In such a case, the inventive technique can also be used advantageously, namely by screwing into sections subjected to transverse tension two or more screws spaced apart and approximately parallel to each other and axially displaced over the height of the beam. Thus, a relatively large segment of a beam can be provided with exceptional transverse tension reinforcement, namely through the screwing in of a multiplicity of screws which are screwed in from the top or the bottom side of the beam and in so doing are screwed in more or less far.

A preferred embodiment provides that the screws are equipped with a thread over their entire shaft length. This ensures that the screws can engage the wood of the beam over their whole length and are therefore capable of absorbing relatively high transverse tension forces.

It is further proposed that the screws have an internal tool drive at their one end, with the diameter of the segment of the screws which surrounds this internal tool drive being made approximately equal to or only slightly greater than the outer diameter of the thread. In this way, it becomes possible to screw the screw in relatively deeply without significant increase of the screwing-in moment and without damage to the threaded region inside the wood. In this way, it also becomes possible to screw the screws in very deeply so as to bring them to just that point where the sections subjected to transverse tension are present.

A preferred and very simple procedure for screwing the screws into the wood beam exists if the screws are screwed in with a screwdriver bit having a shaft adjoining the screw-engaging region, or an imaginary cylinder enclosing the shaft, which has a diameter that is equal to or smaller than the diameter of the portion of the screw which surrounds the internal tool drive and which has a length sufficient to bridge the region of the height of the beam from the internal tool drive of the screw all the way to the upper or lower limit, and beyond to the screwdriver engagement point. Thus, by use of a relatively long screwdriver bit the screws can be screwed to the desired depth into the wood beam. Without requiring pre-drilling, there is therefore created the possibility to place the screw at the appropriate location relative to the height of the beam.

Figure 3:
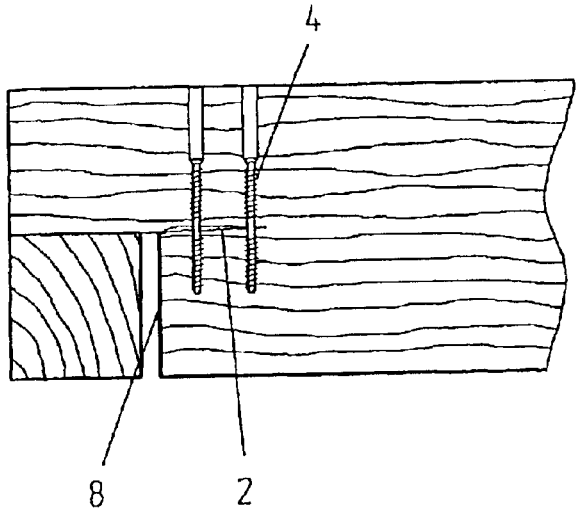
Figure 2:
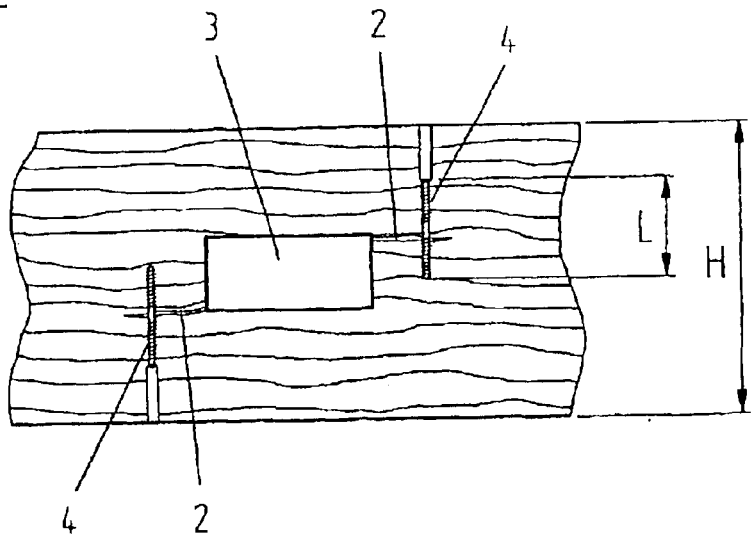
Figure 4:
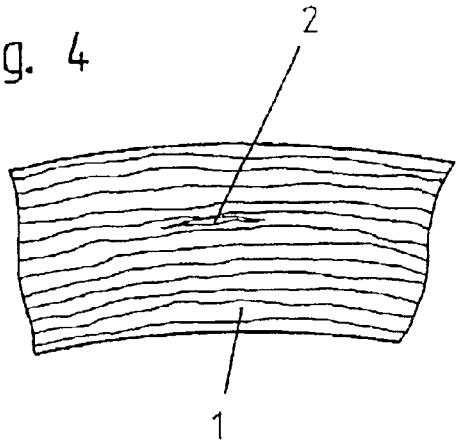
Figure 5:
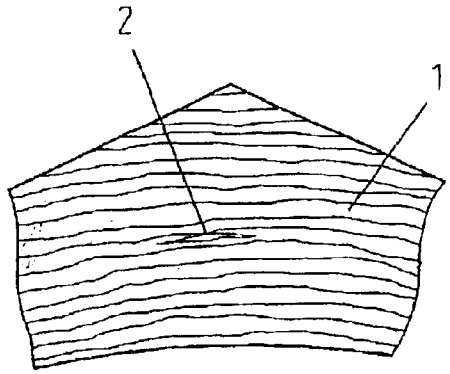
Figure 6:
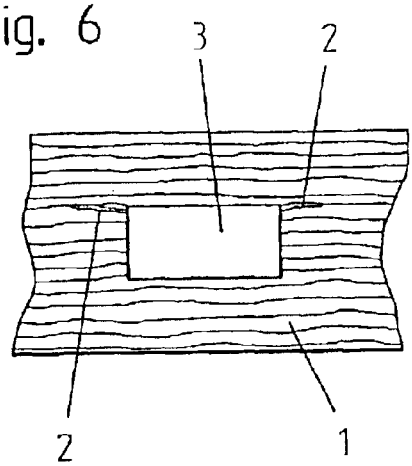
Figure 7:
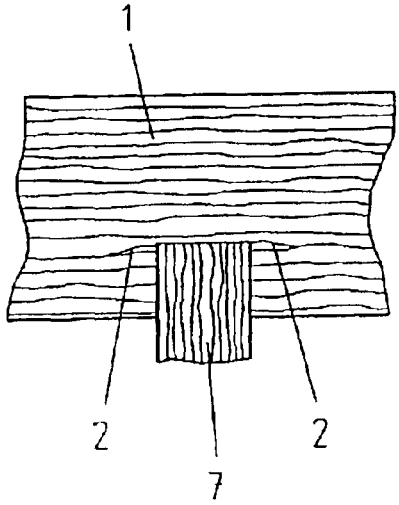

Additional inventive characteristics and special advantages are described further in the following description with reference to the drawings. There is shown by:

FIG. 1 a segment of a curved wood beam in cross-section, illustrating different segments subjected to transverse tension;

FIG. 2 an enlarged illustration of a section from the beam according to FIG. 1 and illustrating a through-hole;

FIG. 3 an enlarged illustration of an end region of a beam having a notch;

FIG. 4 to FIG. 8 various embodiments and portions of wood beams, in particular showing sections subjected to transverse tension.

In a wood beam 1 there exists a series of zones 2 subjected to transverse tension, which extend substantially in the lengthwise direction of the beam 1, i.e. in the grain orientation of the wood. Whether the entire cross-section of this beam is formed of solid wood or of laminated wood, i.e. as a glued laminate, has practically no influence upon the behavior of sections subjected to transverse tension, because transverse tension is always present in the region of cutouts or through-holes 3 as well as in other regions.

In place of the previously common techniques (predrilling—insertion of rod-shaped elements—gluing-in of these rod-shaped elements—relatively long drying period for the adhesive) a screw 4 is now to be screwed directly into the entire material of beam 1. These screws 4 which are to be used here have threaded segments at least at both of their end regions. However, it is also possible to provide a thread over the entire shaft length of the screws 4. For beams 1 of relatively great height H the length L of the screws 4 is less than one half the height H of the beam 1.

For beams of lesser height H, this relationship to the length L of the screws 4 can also proceed in the opposite sense. Only as an example, it can be stated that for a beam height H of one meter a length L of 20 cm or less can be used for screws 4.

This is possible especially because the screws 4 are placed precisely at the zone subjected to transverse tension. After screws 4 are screwed in from the top side 5 or from the bottom side 6 of the beam 1, the screws 4 are screwed in so far that they are located immediately adjacent to the zone 2 subjected to transverse tension. From FIGS. 1 to 3 it can also be seen that the screws 4 preferably extend approximately equally far above and below such a zone 2. This enables optimum absorption of the transverse tension forces by the regions of beam 1 adjacent to the respective zones 2.

Especially in the illustration of FIG. 1 (example all the way to the right) it is shown that in the segments subjected to transverse tension several zones are distributed over the height H of beam 1 which are subjected to transverse tension. Into these sections there can be screwed in two or more screws 4 spaced apart and oriented approximately parallel to each other, with these being screwed in axially, i.e. displaced from each other over the height H of beam 1.

Within the scope of the invention it is also possible to screw in two, or more than two screws 4 immediately behind each other co-axially, in which case the first screw must be sunk in sufficiently deeply. In such a case, the next following screw can optionally have a larger outer diameter. Screws 4 can also be screwed in co-axially from opposite sides, i.e. from the topside 5 and bottomside 6 of beam 1, if the screws are to extend over a correspondingly larger region of the height H of beam 1.

The screws have an internal tool drive at one of their ends, the diameter of the section of screws 4 which surrounds the internal tool drive being as large as, or only slightly larger than the outer diameter of the thread. This makes possible relatively easy screwing in of screws 4 into this relatively deeply sunk in position since the large "head" of the screw does not create a significant increase in turning moment during screwing in of screws 4.

The screwing in of screws 4 into this relatively deeply sunk-in position can be accomplished in simple manner with an appropriate screwdriver bit whose shaft adjoining the engagement region for applying to the screw, or an imaginary cylinder enclosing the shaft, has a diameter which is equal to or smaller than the diameter of the section of screw 4 surrounding the internal tool drive. This screwdriver bit is long enough to bridge the portion of the beam height H from the internal tool drive of screw 4 to the upper or lower limit 5 or 6 of the beam 1, and beyond to the screwdriver engagement point. In this connection, it is also possible to provide, for example on the screwdriver bit, appropriate markings in order to be able to precisely determine into which screwed-in depth in beam 1 the screw 4 has been driven. Thus the screwdriver bit could be provided, for example, with indentations, color markings or the like.

Depending upon the particular area of application of screws 4, i.e. depending upon the configuration and shape of the through-holes in a beam 1, depending upon its curvature or upon its span width, sections subjected to transverse tension also occur at various segments of the beam 1 and therefore also very specific zones 2 subjected to transverse tension. For example, from FIG. 4 it can be seen that such zones 2 subjected to transverse tension exist in the middle region of the length of curved beams 1. Likewise, such zones 2 subjected to transverse tension occur in beams which exhibit a kind of roof shape on their upper sides. Here, too, transverse tension forces occur in practice in the middle region relative to the overall length of the beam. From FIG. 6 it can be seen that for a through-hole 3 the zones which are subjected to transverse tension are not necessarily present at different heights on both sides of this through-hole 3, but can also be experienced at the same height. This is appropriately determined as a function of the loading of a wooden beam.

Figure 8:
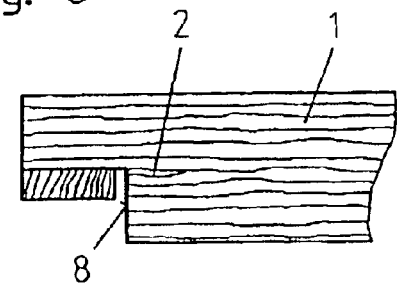

Zones 2 subjected to transverse tension also occur at a U-shaped notch in a beam 1, for insertion of a transversely extending girder 7. In the embodiment of FIG. 8 there is illustrated an addition to the arrangement encountered in practice, which is also illustrated in FIG. 3. At a corresponding notch 8 in wooden beam 1, there also occurs, right in the illustrated region, a zone 2 which is subjected to transverse tension.

In all of these sections subjected to transverse tension, and especially in the specific zones 2 subjected to transverse tension, the use in accordance with the invention of screws which are screwed in directly, i.e. without predrilling, appropriate transverse stress reinforcement can be achieved.

What is claimed is:

1. A wooden beam comprising sections subjected to transverse tension which are reinforced by rod-shaped elements which extend substantially transversly to the longitudinal direction thereof, the rod-shaped elements are formed by screws (4) provided at least in both their end portions with threaded segments having threads, which extend across a zone (2) subjected to increased transverse tension and are screwed in from the top or the bottom side of the beam (1), extend over only a portion of a height (H) of the beam, a length (L) of the screws (4) being less than one-half the height (H) of the beam (1), and thus are associated directly with the zone (2) subjected to increased transverse tension.

2. A beam according to claim 1, characterized in that the screws (4) extend approximately equally far above and below said zone (2) subjected to increased transverse tension.

3. A beam according to claim 1, characterized in that in sections subjected to transverse tension, two or more screws (4) are screwed in spaced-apart and oriented approximately parallel to each other and displaced axially from each other over the height (H) of the beam (1).

4. A beam according to claim 1, characterized in that the screws (4) are provided with a thread along an entire shaft length.

5. A beam according to claim 1, characterized in that the screws (4) have at one end an internal tool drive, a diameter of the portion of the screws (4) surrounding the internal tool drive being approximately as large or only slightly larger than the an diameter of the thread.

6. A beam according to claim 1, characterized in that the screws (4) are screwed in with a screwdriver bit having a shaft adjoining an engagement region for applying to the screw (4), or an imaginary cylinder enclosing the shaft, which has a diameter which is equal to or smaller than a diameter of a portion of screw (4) which surrounds the internal tool drive and has a length which bridges a portion of the height (H) of the beam (1) from the internal tool drive of screw (4) to an upper or lower limit (5, 6), and beyond to the screwdriver engagement point.

7. A beam according to claim 1, wherein said zone (2) is a through-hole or cutout in the beam.

8. A beam according to claim 7, wherein said zone (2) includes a crack in said beam extending from said through-hole or cutout.

* * * * *